US008356956B2

(12) United States Patent
Smith

(10) Patent No.: US 8,356,956 B2
(45) Date of Patent: Jan. 22, 2013

(54) NON-BOLTED BRIDGE PARAPET BARRIER

(76) Inventor: Rodney I. Smith, Midland, VA (US)

( * ) Notice: Subject to any disclaimer, the term of this patent is extended or adjusted under 35 U.S.C. 154(b) by 0 days.

(21) Appl. No.: 13/558,486

(22) Filed: Jul. 26, 2012

(65) Prior Publication Data

US 2012/0288327 A1 Nov. 15, 2012

(51) Int. Cl.
*E01F 15/02* (2006.01)

(52) U.S. Cl. ..... 404/73; 52/747.1

(58) Field of Classification Search ..... 52/745.13, 52/745.15, 745.2, 747.1; 404/6, 73; 256/1, 256/13.1; 49/506
See application file for complete search history.

(56) References Cited

U.S. PATENT DOCUMENTS

| | | | | |
|---|---|---|---|---|
| 4,986,042 | A * | 1/1991 | Richardt | 52/102 |
| 5,046,884 | A | 9/1991 | Girotti | |
| 5,134,817 | A * | 8/1992 | Richardt | 52/102 |
| 5,149,224 | A | 9/1992 | Smith | |
| 5,156,485 | A | 10/1992 | Ivey et al. | |
| 5,464,306 | A | 11/1995 | Cristiano | |
| 5,605,413 | A | 2/1997 | Brown | |
| 5,685,665 | A | 11/1997 | Lembo | |
| 5,697,728 | A | 12/1997 | Camomilla et al. | |
| 6,485,224 | B1 | 11/2002 | Dyke et al. | |
| 6,767,158 | B1 | 7/2004 | Consolazio et al. | |
| 7,226,236 | B2 | 6/2007 | Mertens | |
| 7,607,645 | B2 | 10/2009 | Smith | |
| 2011/0076098 | A1 * | 3/2011 | Smith | 404/6 |

FOREIGN PATENT DOCUMENTS

| | | |
|---|---|---|
| JP | 9268531 | 10/1997 |

* cited by examiner

*Primary Examiner* — Gary S Hartmann
(74) *Attorney, Agent, or Firm* — Whitham, Curtis, Christofferson & Cook, P.C.

(57) ABSTRACT

Increased resistance to displacement of a barrier or barrier sections thereof in response to a lateral force without anchoring or bolting barrier sections together is achieved by providing an attachment arrangement near the top of an end of barrier sections which is capable of carrying a tensile force and developing that tensile force using a tightening bolt/nut arrangement located at deflection stops at lower corners of the barrier sections to develop a compressive force. The barrier sections are thus rigidly attached together such that a lateral force applied to one or more barrier sections is partially transferred to additional attached barrier sections effectively increasing the mass against which the lateral force is applied. The tightening bolt/nut arrangements are retained by and are captive to the respective barrier sections when barrier sections are disassembled from each other.

4 Claims, 6 Drawing Sheets

NON-BOLTED BRIDGE PARAPET BARRIER

CROSS-REFERENCE TO RELATED APPLICATIONS

This application claims priority of the filing date of U.S. Provisional Patent Application Ser. No. 61/247,410, filed Sep. 30, 2009, which is hereby incorporated by reference herein in its entirety.

FIELD OF THE INVENTION

The present invention generally relates to portable, temporary safety barriers such as may be used for restraining movement of people, animals and/or vehicles to designated areas and, more particularly, to preventing movement into areas deemed to be particularly dangerous such as parapets at the edges of structures such as bridges and the like where resistance to barrier movement from lateral forces and impacts is particularly critical.

BACKGROUND OF THE INVENTION

Permanent safety barriers along traffic thoroughfares are well-known and commonplace to prevent vehicles from leaving the roadway or shoulder area in the event of an accident or loss of operator control of a vehicle, particularly at locations where an area adjacent to the thoroughfare may be deemed particularly dangerous, such as where the roadway may be significantly elevated above the surrounding grade or on bridges over water. Such barriers are generally metal and cable constructions which are firmly anchored to the earth or integrally formed with the roadway structure such as a bridge or overpass. In recent years, construction of roads and other areas where vehicles, pedestrians or animals may be present has led to the development and deployment of portable barriers (generally formed in segments of six to twelve foot length of cast reinforced concrete or as plastic shells which can be filled with water; the latter type providing the additional benefit of impact energy dissipation) that can similarly restrain movement of vehicles, people or animals into undesired or dangerous areas by virtue of their substantial weight even when deployed as stand-alone structures with no anchorage but which (by virtue of their lack of anchorage) can be moved and placed, at will, using fairly commonplace and generally available machinery such as a truck-mounted hoist, fork lift or so-called front-end loader (or even manually when of the water filled type when the water is drained therefrom). Such portable barriers are generally shaped to deflect impacts from vehicles (and resist being climbed by pedestrians or animals) by being formed with a progressively tapered shape in the vertical direction and are sometimes referred to as "Jersey walls" or "Jersey barriers".

However, when deployed as stand-alone structures without being anchored in place, such barriers or individual segments or sections thereof can be overturned or moved by a sufficient lateral force or impact that overcomes their stability due to their weight or their frictional engagement with the ground or pavement on which they are deployed. On the other hand, if anchorage is provided for the barriers such as bolting the barriers to each other or to anchors in the ground or pavement, presenting substantial material and labor costs, portability is compromised since the anchorage must be removed before the barrier can be moved. Further, such anchorage causes a trade-off between the labor involved to provide and remove the anchorage, including the collection and storage of relatively small parts such as bolts, washers, nuts and plates, and the level of impact resistance that the barriers can provide or withstand. In many cases, even when the anchorage is elaborate and provides substantial additional strength (and corresponding level of difficulty and cost of installation and removal), that level of strength will not be commensurate with the level of protection which is deemed desirable in view of the level of danger contemplated should the barrier fail to remain stationary. Such a circumstance where movement of a barrier might prove catastrophic is, for example, that of a parapet of a bridge over a body or water or at a substantial height above surrounding terrain where movement of a barrier by only a short distance could allow a vehicle to leave the roadway. Nevertheless, a demand remains for easily portable barriers even for such critical applications.

SUMMARY OF THE INVENTION

It is therefore an object of the present invention to provide a portable barrier of substantially increased resistance to movement and strength without bolting of barrier sections to each other or providing anchorage to the ground, pavement or other structure while allowing barrier sections to be easily, quickly and readily separated and requiring only minimal hardware or material cost.

It is another object of the invention to provide a portable barrier section for assembly with other similar barrier sections to form a barrier having increased resistance to movement wherein a barrier section can be detached from another barrier section while all attachment hardware remains attached to the barrier section.

In order to accomplish these and other objects of the invention, a barrier section is provided including an attachment arrangement for attaching the barrier section to another barrier section and capable of carrying a tensile force, deflection stops at selected corners of barrier section, and a tightening bolt/nut arrangement attached to selected ones of the deflection stops and capable of carrying a compressive force.

In accordance with another aspect of the invention, a barrier comprised of a plurality of barrier sections is provided, wherein each barrier section comprises an attachment arrangement for attaching the barrier section to another barrier section and capable of carrying a tensile force, deflection stops at selected corners of the barrier section, and a tightening bolt/nut arrangement attached to selected ones of the deflection stops and capable of carrying a compressive force.

In accordance with a further aspect of the invention, a method of increasing resistance to movement of a barrier comprised of a plurality of barrier sections in response to a lateral force applied thereto is provided comprising steps of attaching a barrier section to another barrier section near the top of respective ends of the barrier sections, and applying compressive force between deflection stops located near lower edges of said barrier sections sufficient to cause tensile force at the location where the barrier sections are attached.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
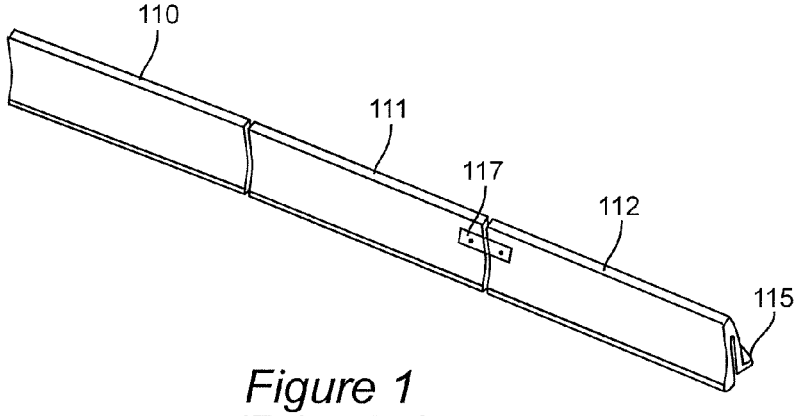
Figure 1 (Prior Art)
FIG. 1 is an isometric view of three interlocked barrier sections as shown in U.S. Published Patent Application 2008/0303010 to Smith (the inventor of the present invention)

Referring now to the drawings, and more particularly to FIG. 1, there is shown an isometric view of three interlocked barrier sections 110, 111, 112, as shown in U.S. Published Patent Application 2008/0303010. As alluded to above, the barrier sections are preferably formed of cast reinforced concrete as are also suitable for use without interlocking as stand-alone barrier sections. The interlocking arrangement may be as simple as a groove 115 which engages a complementary tab or tongue on the opposite end of each section. If a lateral force is applied to any section or group of sections sufficient to cause lateral displacement thereof, the tongue provides for transfer of some portion of the force to the adjacent barrier section and provides some degree of increase of resistance to such lateral displacement. However, the degree of resistance to lateral displacement is relatively small and limited in effect to small barrier section displacement since a relatively small displacement will cause the tongue to become disengaged from the groove 115 or breakage of the tongue and/or groove. The resistance to lateral motion can be enhanced only to a limited degree by placing the barrier sections tightly against each other such that the wider base of the barrier sections (which are progressively tapered, as alluded to above) will bear against each other and require some relative movement of the barrier in the direction of its length or increased relative angular shifting before disengagement of the barrier sections from each other can occur. Conversely, placement of the barrier sections to follow a curving path necessarily compromises the integrity of the tongue and groove interlocking arrangement.

It should be noted that, with such a simple arrangement for interlocking of the barrier sections, no attachment of the sections to each other is provided which is capable of carrying a tensile load as would tend to maintain the attachment of each barrier section to adjacent sections when barrier sections are displaced from a configuration in which they are aligned with each other. Such an attachment arrangement could, for example, be provided by plates 117 which are through-bolted to the barrier sections across the respective interfaces therebetween. However, such plates are limited in effectiveness to maintain alignment between barrier sections while it can be readily appreciated that such a bolting arrangement, while of minimal complexity, can cause a severe impediment to movement or relocation of the barrier sections when it is desired to do so. Not only must the bolting arrangement be disassembled but numerous relatively small parts must be collected and stored until the barrier sections are again deployed.

Figure 2:
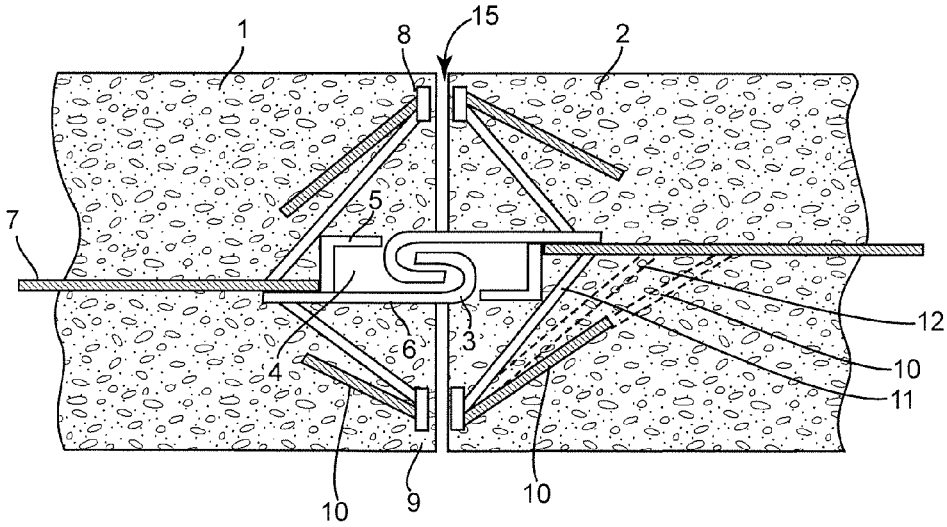
Figure 2 (Prior Art)
FIG. 2 is a top plan view of an interface of two barrier sections as disclosed in U.S. Pat. No. 5,149,224, also to Smith.
Figure 3:
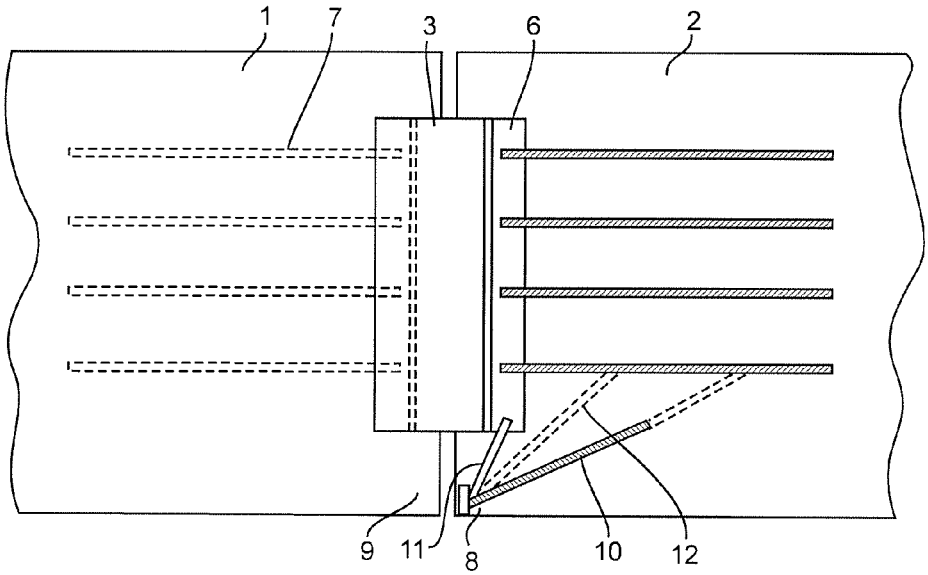
Figure 3 (Prior Art)
FIG. 3 is a side cutaway view of an interface of two barrier sections showing deflection stops as disclosed in U.S. Published Patent application 2008/0303010, noted above.

A partial solution to this problem is provided in U.S. Pat. No. 5,149,224 and illustrated in FIGS. 2 and 3 showing a partially cutaway plan view and a partially cutaway elevation view, respectively, of an interface between two barrier sections, 1, 2, including a single "J"-shaped connection 6 with curved hook portion 3 and deflection stops 8 in an end of respective barrier sections, preferably connected by a reinforcement 11. This combination of elements or the "J"-shaped connections, themselves, are sometimes referred to as JJ hooks®. The "J"-shaped connections 6 preferably include a member 5 which simplifies the casting of the reinforced concrete barrier sections and provides additional clearance 4 for interlocking the "J"-shaped members 6 and assists in maintaining the interlocked positioning when stress is caused by moving the barrier sections out of alignment where displacement stops 8 are driven together by the relative angular displacement between barrier sections. Additionally, it is considered desirable that the end of the curved hook portion 3 extend back into the clearance space 4 such that greater deformation of the "J"-shaped members will be required before interlocked "J"-shaped members will become disengaged from each other when a lateral force is applied against a barrier section. Reinforcement members 10, 12 of cable or metal rods (e.g. reinforcing rods or "rebars") and cables or rods 7 which extend through the length of the barrier sections are also preferably attached in a robust manner (e.g. by welding) to the "J"-shaped connections 6 so that any tensile force resulting from displacement of the barrier sections can not only be withstood but transferred to additional barrier sections that may be attached together. The deflection stops 8 at outside corners 9 of the wider bottom portion of the barrier are also preferably reinforced in a similar manner to bear a compressive load as indicated at locations 10, 11 and 12.

It should be appreciated that this connection arrangement for barrier sections provides for secure attachment of the barrier sections to each other in a manner capable of carrying tensile stress but does so without bolting of the barrier sections together or anchorage of the barrier sections and in a manner such that the barrier sections can be readily disengaged from each other in a vertical direction by lifting of only a single barrier section; a motion very unlikely to be produced by a lateral force due to impact from a vehicle unless one or more barrier sections is overturned (which is effectively resisted by placing the "J"-shaped connections at the top of the ends of the respective barrier sections).

While this arrangement provides greatly enhanced strength and resistance to lateral displacement with minimal compromise of convenience when barrier sections are to be moved or relocated, these properties are not fully developed until a barrier section has been displaced sufficiently for the "J"-shaped connection to transfer forces to and possibly displace an adjacent barrier section and, thereafter for gap 15 to be closed such that the deflection stops 8 of adjacent barrier sections bear against one another and the "J"-shaped connections drawn tightly against each other; causing the full strength and resistance to displacement to be developed in stages as a function of the displacement distance that may or may not be available in a given potential application. While this characteristic may be tolerable in many applications, other applications may require barrier section displacement to be minimized if not eliminated and original, as placed, alignment of the barrier sections to be maintained with substantial rigidity of the assembled barrier, together with minimizing compromise of ease of detachment of sections and portability.

Figure 4A:
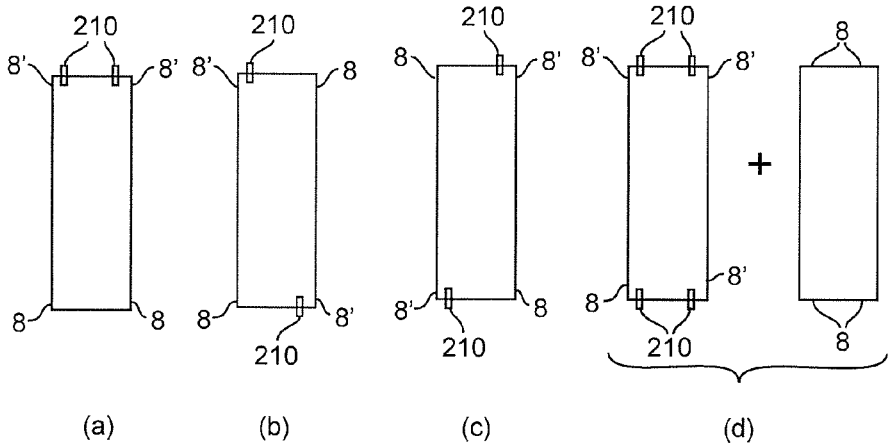
FIG. 4 is a partially cutaway plan view of an interface of two barrier sections in accordance with the invention, FIG. 4A show a plurality of barrier sections in plan view indicating alternative locations of tightening bolt/nut arrangements in accordance with the invention.
Figure 4:
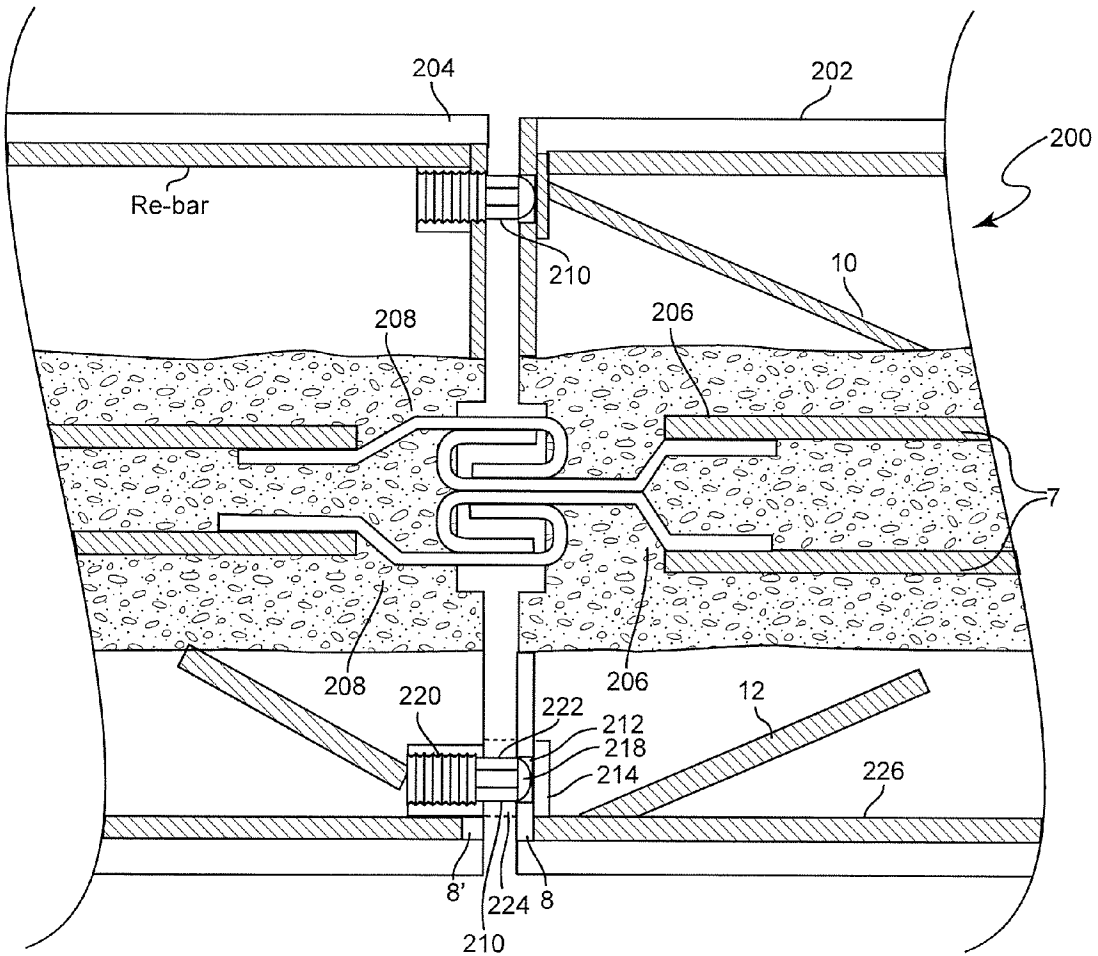
Figure 5:
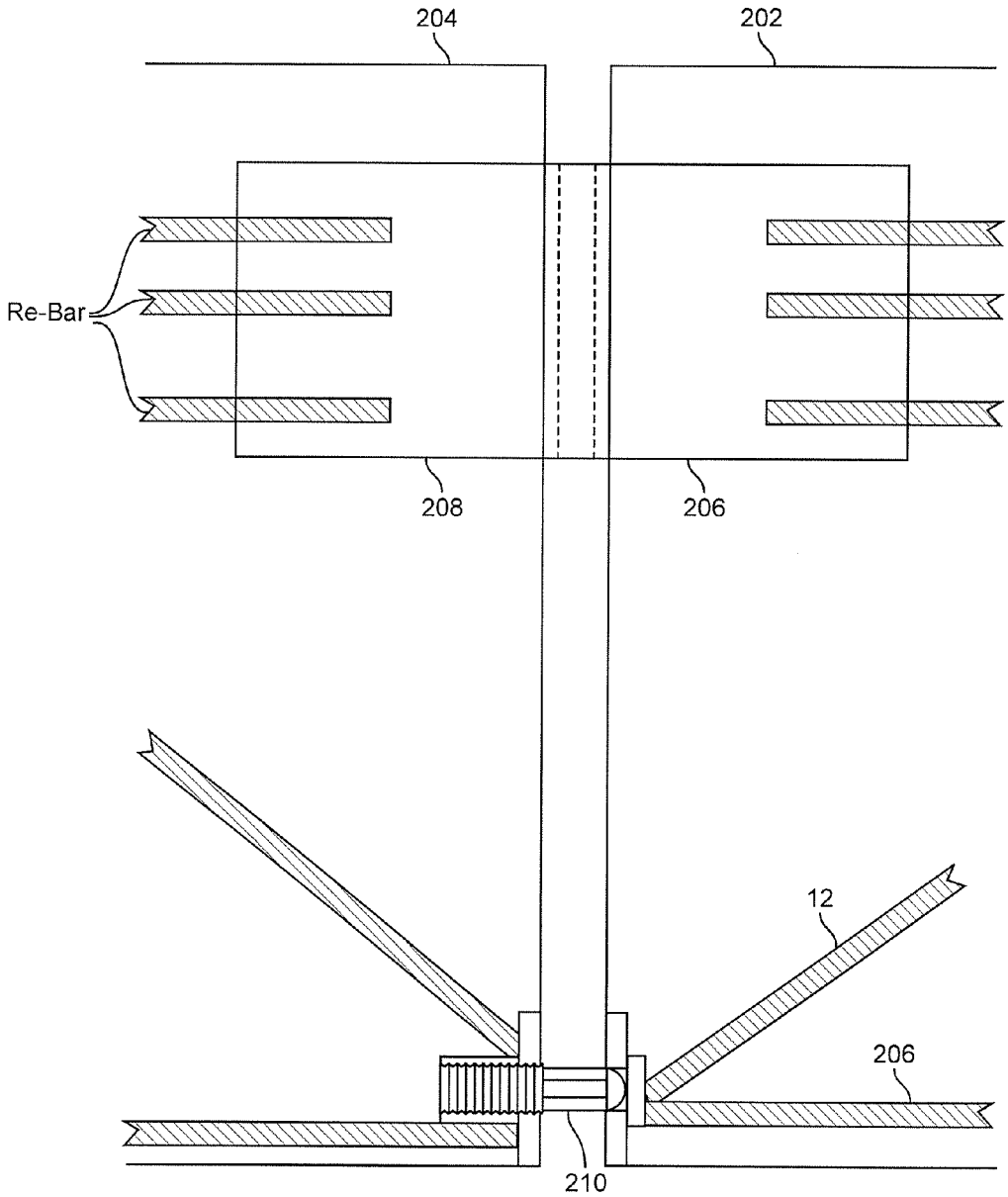
FIG. 5 is a partially cutaway elevation view of an interface of two barrier sections in accordance with the invention.

Such additional meritorious effects are produced in accordance with the invention as depicted in the partially cutaway plan view thereof of FIG. 4 and the partially cutaway elevation view thereof of FIG. 5. As may be seen from the plan view of the interface 200 between barrier sections 202, 204 of FIG.

4 as compared with that of FIG. 2 discussed above, the invention preferably employs a double "J"-shaped connection 206, 208 (sometimes referred to as a double JJ hook™ although the single "J"-shaped connection of FIG. 2 is also suitable for the successful practice of the invention. The double "J"-shaped connection is symmetrical and thus is equally strong for either direction of angular deflection between barrier sections. Perhaps more importantly, the double "J"-shaped connection is substantially less susceptible to deformation in response to applied stress while the respective interlocking portions will come into contact and bear a greater tensile load with substantially less deflection. The double "J"-shaped configuration also allows more reinforcement elements 7 to be applied. It can be seen from a comparison of the exemplary structures of FIGS. 3 and 5 that only four reinforcing elements are provided in the structure of FIG. 3 while at the same proportional reinforcement element volume and spacing, six similar reinforcing elements can be provided in the structure of FIG. 5 while decreasing the height of the double "J"-shaped connection compared to the single "J"-shaped connection of FIG. 3 and increasing the effective height at which it can be placed in the barrier section. This potential increase in connection height may be of additional convenience when assembling or disconnecting barrier sections; requiring the barrier section to be lifted through a reduced height and reducing the tendency of the connection parts to bind against each other when slightly misaligned during such lifting operations. The decreased height of the double "J"-shaped connection also allows tensile stresses to be carried at a location closer to the top of the barrier sections which resist overturning of the barrier sections as well as more closely approximating the likely location of an impact from a vehicle; increasing overall effective barrier strength. Further, as will be discussed in greater detail below, increased vertical separation of the connection arrangement from the deflection stops 8 and the tightening nuts/bolts 210 in accordance with the invention provides increased rigidity of assembled barrier sections for a given level of forces developed between the barrier sections.

Additionally, a principal feature of the invention is the inclusion of tightening bolts/nuts 210 preferably provided at the bottom deflection stops 8', preferably in a manner that they will remain "captive" to the barrier sections thereby eliminating any need to collect and separately store any connection hardware when the barrier sections are disassembled. These tightening bolts/nuts can be provided at one end (shown at (a) of FIG. 4A) or at opposing corners (shown at (b) or (c) of FIG. 4A) of each barrier section such that all barrier sections can be configured identically (although potentially of differing lengths). It should be noted that configurations (b) and (c) allow the barrier sections to have identical end configurations which, when used with (single) "J"-shaped connections, provides a symmetry which allows either end to be connected to either end of an adjacent barrier section; which advantage during barrier assembly would not be maintained using configuration (a). In contrast, use of a double "J"-shaped connection requires that the ends of the barrier sections be differently configured and configuration (a) for the tightening nuts/bolts 210 causes no additional disadvantage. Alternatively, such tightening bolt/nut arrangements can be provided at all four corners of alternating barrier sections (shown at (d) of FIG. 4A) in which case, two slightly different barrier section configurations would be required and thus configuration (d) is not preferred.

It is also considered very important but not indispensable to the successful practice of the invention to provide an aperture 212 in the deflection stops 8 and to provide a backing plate 214 which can be welded to deflection stop 8 to cover the aperture and thus form a socket to receive the end 218 of the tightening bolt/nut arrangement 210. Doing so, particularly in combination with the single or double "J"-shaped connection, and where the end of the tightening bolt/nut arrangement is closely received in the socket, tends to increase the rigidity of the interface between barrier sections in a rotational direction; further resisting the overturning of barrier sections due to lateral forces. The configuration of the tightening bolt/nut arrangement and its attachment to deflection stop 8' are important to the practice of the invention in view of the load that potentially must be carried. For example, the tightening bolt/nut arrangement can simply have a threaded portion 220 which engages complementary threads in deflection stop 8' and a flatted portion 222 (e.g. preferably having a hexagonal prism form to be engaged, for example, by an open-end wrench) by which it can be gripped and turned to be brought into engagement with the opposing deflection stop 8 or a socket formed therein as discussed above. In general, the length of the prism form portion (including an optional cap portion which may be rounded or tapered to facilitate alignment with and seating in a socket) should be slightly greater than the sum of the maximum design gap between barrier sections and the socket depth. The length of the threaded portion should be approximately twice the length of the prism portion to assure a substantial and sufficient length of threaded engagement in the deflection stop when the tightening bolt/nut arrangement is fully extended. Other suitable tightening bolt/nut arrangements will be apparent to those skilled in the art in view of the examples shown in FIGS. 4-7.

Some additional reinforcement elements 226 can preferably be included as the barrier section is manufactured (e.g. cast) to bear the pre-load which is preferably generated by the tightening bolt/nut arrangements. Since rigidity of the assembled barrier will increase with increase of the pre-load, the pre-load forces are preferably large, comparable to several times the weight of a barrier section and/or a significant fraction of the force corresponding to the yield point of the "J"-shaped of double "J"-shaped connections. Of course, the pre-load force should not closely approach the yield point of the "J"-shaped or double "J" shaped connections (collectively referred to as attachment arrangements) since such a large pre-load would diminish the additional lateral force that could be borne before failure of these connections if some movement of the barrier is caused. However, it is important that the pre-load force is in a general range to achieve substantial rigidity of the assembled barrier although the actual pre-load force to achieve that effect will vary with individual barrier designs in accordance with the invention to meet particular specifications to resist shifting of the barrier due to a given level of lateral forces. Suitable levels of pre-load force can be determined from a very few test impacts and corresponding torque to be applied to the tightening bolts can be readily specified for individual barrier designs.

When the connection arrangements (e.g. 6 or 206, 208) have been engaged and the tightening bolt/nut arrangement is tightened against the opposing deflection stop 8, the barrier sections are pushed apart and the JJ hook or double JJ hook connection arrangement is brought tightly together.

The tightening bolt/nut arrangement is preferably further tightened to a predetermined torque, as alluded to above, to provide a pre-load of the assembled barrier sections in tension in the connection arrangement and in compression in the tightening bolt/nut arrangement; increasing rigidity of the assembled barrier sections in all degrees of freedom. It should be noted that such rigidity can be achieved even if the barrier sections are set at a slight angle to each other (e.g. to follow a curving roadway of typical radius). Thus any lateral force that might be sufficient to cause displacement of the mass of a single barrier section will be directly transferred to one or more adjacent barrier sections at each end of the barrier section(s) to which the lateral force is applied and thus increases the effective mass and serves to resist movement or overturning due to the lateral force.

In addition to effectively coupling mass of the barrier sections to each other to increase resistance to motion of the barrier sections due to lateral impact, without wishing to be held to any particular theory of operation, it appears that a portion of the effective weight of adjacent sections may be transferred between barrier sections to increase frictional engagement with the earth or pavement on which they are placed at the point of onset of displacement of a barrier section through the moment of the tension and compression forces at the juncture of barrier sections. Thus the magnitude of lateral force required to cause displacement of a barrier section is greatly increased while the only further compromise of convenience of moving barrier sections, when desired, involves only loosening the tightening bolt/nut arrangements adequately to disengage them from sockets 212, 214 but without removal of hardware parts from the barrier sections. It should be appreciated that this increase in force required for displacement of a barrier section is achieved without bolting the barrier sections together and without provision of anchorage of any kind.

Figure 6:
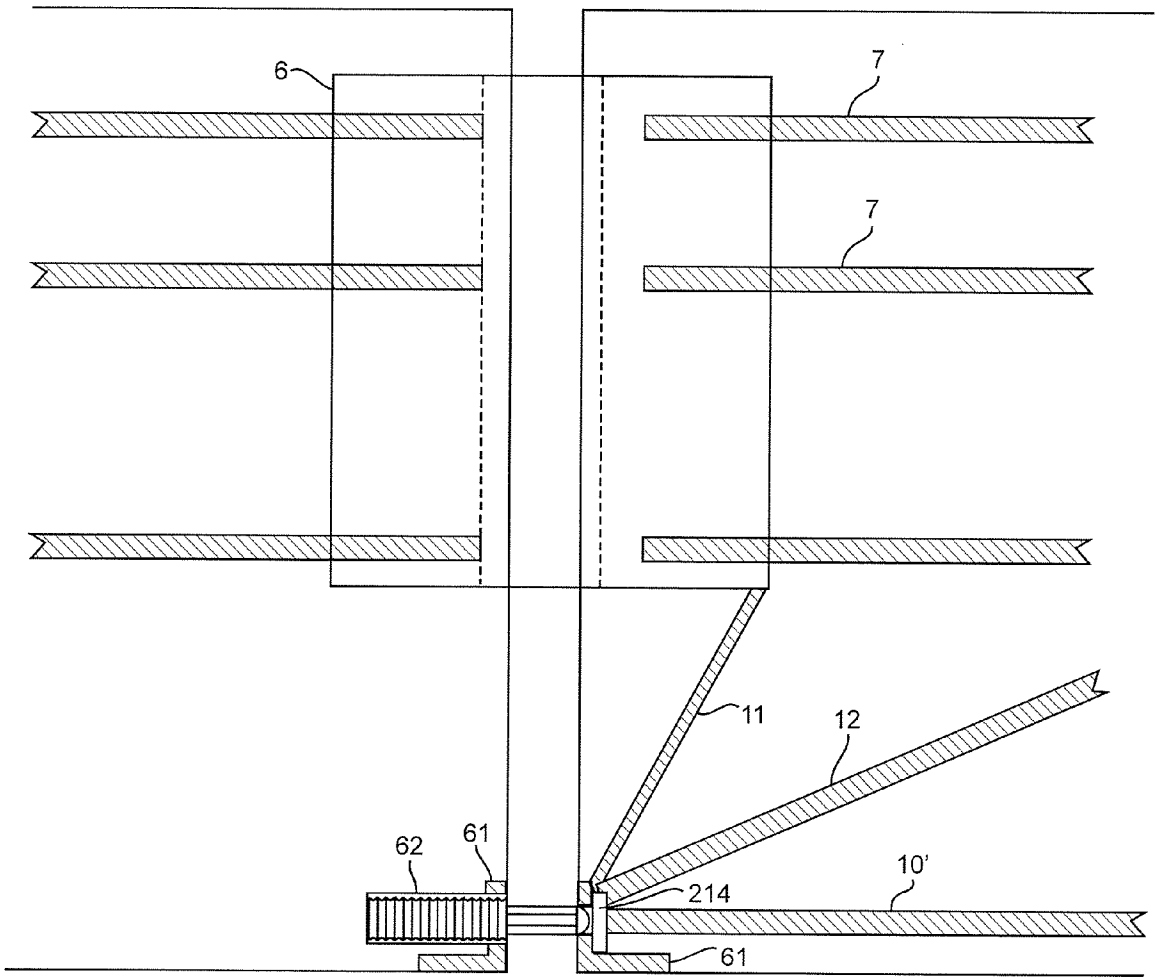
FIG. 6 is a partially cutaway plan view of a preferred embodiment of the invention.
Figure 7:
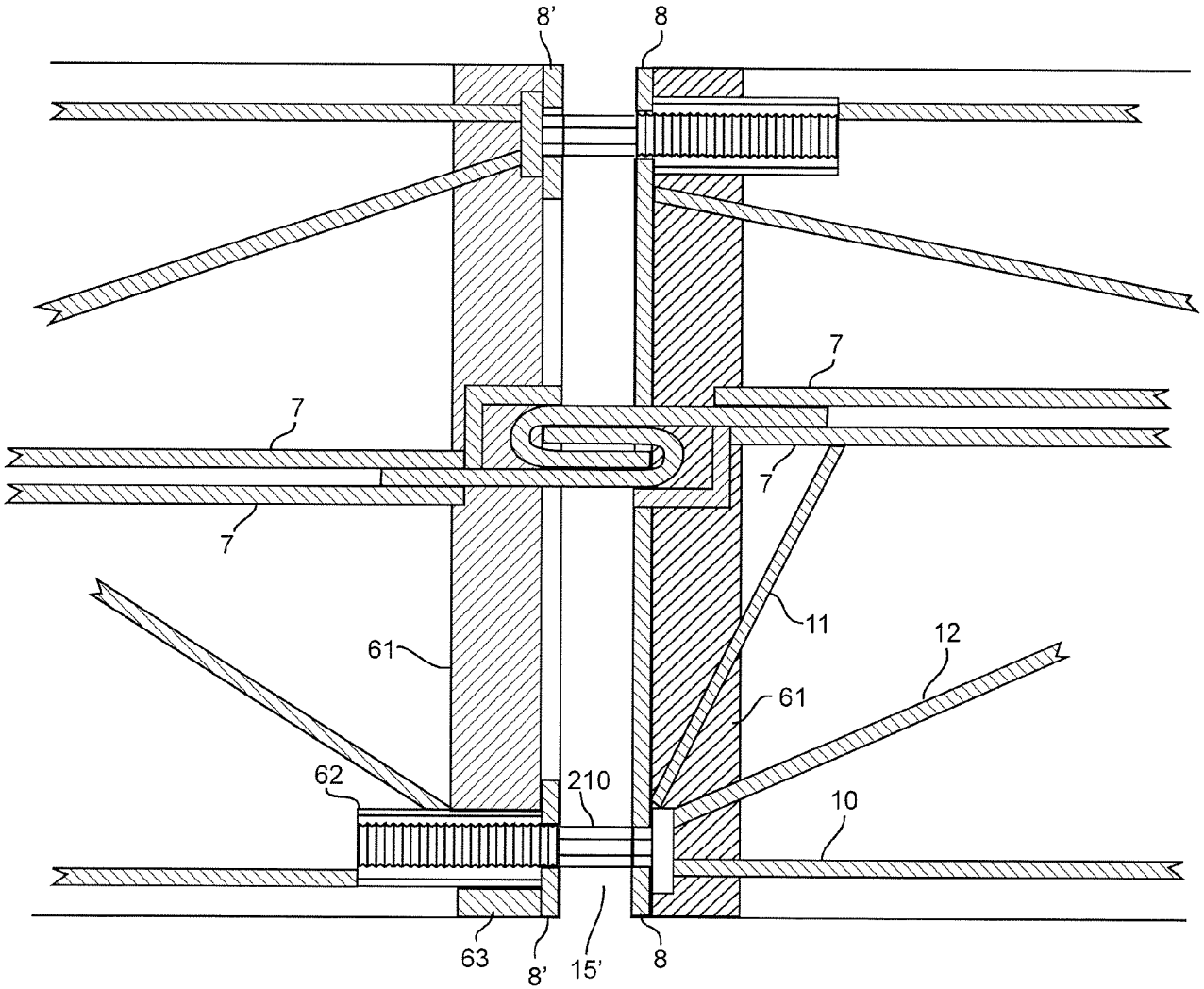
FIG. 7 is a partially cutaway elevation view of the preferred embodiment of the invention.

Referring now to FIGS. 6 and 7, a preferred embodiment and construction of the invention will now be discussed in detail. Single "J"-shaped connections 6 are illustrated as being preferred due to the advantage of providing identical end configurations of the barrier sections, as alluded to above. However, double "J"-shaped connections may be employed and may provide some advantages in strength, as alluded to above. If single "J"-shaped connections are employed, they should be formed of material of sufficient strength to be comparable to the double "J"-shaped connections. A "J"-shaped connection having a height of about eighteen inches and formed of one-half inch thick steel is considered to be sufficient for most applications. Rods or cables 7 which extend through the length of each barrier section are doubled in number as illustrated in FIG. 7 and are preferably formed of reinforcing rod of increased diameter as compared with the barrier section illustrated in FIGS. 2 and 3 and preferably are more closely spaced toward the top of the "J"-shaped connections. A diameter of about ¾" is considered to be sufficient for most applications. These reinforcing rods are preferably welded to the connection arrangements.

As alluded to above, the tightening bolt configuration is preferably in accordance with configuration (b) or (c) of FIG. 4A (configuration (c) being illustrated) to correspond to the use of single "J"-shaped connections. Deflection stops 8 and 8' are preferably formed of a single metal angle 61 of structural iron or steel running the entire width of the barrier section. (A structural steel angle of 3"×3" by ½" cross-section is generally sufficient for most applications. Backing plates 214 should be of similar thickness and are preferably welded thereto. If desired, one or more layers of backing plates 214 with apertures therein may be optionally provided to increase socket depth.) Reinforcing rods 10' preferably run the entire length of the barrier section and is also preferably of heavier construction than the reinforcing elements 10 of the barrier section of FIGS. 2 and 3. Reinforcing elements 11 and 12 are also preferably of increased strength and may be increased in number as a given design strength may require. One or more reinforcing elements 12 should preferably be placed at an angle to the direction of the length of a barrier section in the horizontal and/or vertical direction since a lateral force applied to a barrier section will result in an angled force being transmitted between assembled barrier sections. Tightening bolts 210 are preferably as described above and engage an internally threaded tube. A tightening bolt diameter of 1½" is considered to be sufficient for most applications. The thread configuration is not critical but should be chosen such that the depth of the threads and the length of the threaded engagement as well as the thickness of the tube walls can support pre-load forces of a magnitude discussed above and large additional forces that may be developed by lateral forces applied to barrier sections. Choice of thread pitch should consider both the level of torque that is needed to develop a desired pre-load force such that the torque can be conveniently applied and the number of turns of the tightening bolt/nut arrangement with a given tool required to engage or disengage barrier sections. It is preferred that these internally threaded tubes 62 be welded to the structural angle 61 as indicated at 63. Other dimensions of the tightening bolt/nut arrangements and locations of attachment arrangements are preferably such that the separation 15' of barrier sections, when assembled, is approximately one and one-half inches or between one and two inches when the assembled barrier follows a curving layout.

In view of the foregoing, it is seen that the invention provides a non-bolted barrier that is comprised of readily portable barrier sections but which exhibits greatly increased resistance to being displaced by a lateral force applied thereto. Portability is not significantly compromised since the barrier section can be disengaged from each other by a simple loosening and retraction of tightening bolt/nut arrangements 210 (that remain captive to the barrier section) to clear the sockets so that the connection arrangements may be disengaged by lifting a barrier section. The tightening bolt/nut arrangements, when tightened to provide pre-load forces, develop a high degree of rigidity which distributes applied lateral forces over a plurality of barrier sections and possibly transfer effective weight between sections to increase frictional engagement with the earth or pavement on which the barrier is assembled. Thus, the barrier section in accordance with the invention is particularly applicable and provides much improved performance and safety in applications where a barrier must be placed close to the edge of a structure or surface, such as a bridge parapet.

While the invention has been described in terms of a single preferred embodiment, those skilled in the art will recognize that the invention can be practiced with modification within the spirit and scope of the appended claims. For example, the invention may be advantageously included in only one end of a specially shaped terminal barrier section for use at an end of an assembled barrier.

Having thus described my invention, what I claim as new and desire to secure by Letters Patent is as follows:

1. A method of increasing resistance to movement of a barrier comprised of a plurality of barrier sections in response to a lateral force applied to said barrier, said method comprising steps of attaching a barrier section to another barrier section near the top of respective ends of said barrier section and said another barrier section, applying compressive force between deflection stops located near lower edges of said barrier sections sufficient to cause tensile force at the location where said barrier section and said another barrier section are attached by said attaching step.

2. A method as recited in claim 1 wherein said compressive force and said tensile force exceed a weight of said barrier section.

3. A method as recited in claim 1, comprising further steps of relieving said compressive force, and disconnecting said barrier section and said another barrier section.

4. A method as recited in claim 3, wherein said step of relieving said compressive force is achieved without removal of hardware from said barrier section or said another barrier section.

* * * * *

UNITED STATES PATENT AND TRADEMARK OFFICE

CERTIFICATE OF CORRECTION

PATENT NO. : 8,356,956 B2
APPLICATION NO. : 13/558486
DATED : January 22, 2013
INVENTOR(S) : Smith It is certified that error appears in the above-identified patent and that said Letters Patent is hereby corrected as shown below:

On the Title Page, please insert the following:

--Related U.S. Applications Data

[62] Division of application No. 12/892,135 filed on Sep. 28, 2010, now issued as U.S. patent No. 8,328,461.

[60] Provisional application No. 61/247,410 filed on Sep. 30, 2009.--

In the Specification

Column 1, at line 6, after "This application" and before "claims priority", please insert the following:

--is a division of U.S. patent application Ser. No. 12/892,135, filed Sep. 28, 2010 now issued as U.S. patent No. 8,328,461 which itself--

Signed and Sealed this
Twenty-fourth Day of June, 2014

Michelle K. Lee

Michelle K. Lee
*Deputy Director of the United States Patent and Trademark Office*